US008448265B2

(12) United States Patent
DuPont

(10) Patent No.: US 8,448,265 B2
(45) Date of Patent: May 28, 2013

(54) GLOVE HAVING MICROPORES

(76) Inventor: Frank S. DuPont, East China, MI (US)

( * ) Notice: Subject to any disclaimer, the term of this patent is extended or adjusted under 35 U.S.C. 154(b) by 344 days.

(21) Appl. No.: 12/764,128

(22) Filed: Apr. 21, 2010

(65) Prior Publication Data

US 2011/0258754 A1 Oct. 27, 2011

(51) Int. Cl.
*A41D 19/00* (2006.01)

(52) U.S. Cl.
CPC ..... *A41D 19/00* (2013.01)
USPC ..... 2/163

(58) Field of Classification Search
USPC ..... 2/163, 167–169
See application file for complete search history.

(56) References Cited

U.S. PATENT DOCUMENTS

| | | | | | |
|---|---|---|---|---|---|
| 1,329,996 | A | * | 2/1920 | Pacifico | 2/159 |
| 2,118,463 | A | * | 5/1938 | Eden | 2/163 |
| 2,242,318 | A | * | 5/1941 | Mosier | 2/159 |
| 4,497,072 | A | | 2/1985 | Watanabe | |
| 4,654,895 | A | * | 4/1987 | Peters | 2/161.1 |
| 4,763,940 | A | * | 8/1988 | Held | 294/25 |
| 5,664,260 | A | | 9/1997 | Weiser | |
| 5,680,654 | A | * | 10/1997 | McClanahan, II | 2/163 |
| 5,682,613 | A | * | 11/1997 | Dinatale | 2/168 |
| 6,065,155 | A | | 5/2000 | Sandusky | |
| 6,122,769 | A | | 9/2000 | Wilder et al. | |
| 6,845,519 | B2 | | 1/2005 | Garneau | |
| 7,178,171 | B2 | | 2/2007 | Griesbach, III | |
| 7,278,170 | B2 | | 10/2007 | Anderson | |
| 7,480,944 | B2 | * | 1/2009 | Nascimento | 2/162 |
| 7,578,006 | B2 | | 8/2009 | Garneau | |
| 2008/0109928 | A1 | * | 5/2008 | Bae | 2/21 |

* cited by examiner

*Primary Examiner* — Katherine Moran
(74) *Attorney, Agent, or Firm* — Young Basile

(57) ABSTRACT

An athletic glove for use in handling a ball includes a single layer of elastic material forming a body that generally conforms in shape to a human hand. The body has four finger portions, a thumb portion, and an outer surface including a palmar side and a dorsal side. The palmar side and the dorsal side each include at least one breathable portion including a plurality of randomly disposed micropores. The four finger portions each include at least one longitudinal slit on the palmar side that provide for direct tactile stimulation of a hand through the glove.

15 Claims, 2 Drawing Sheets

GLOVE HAVING MICROPORES

TECHNICAL FIELD

This invention relates to athletic gloves, and more particularly to an athletic glove for handling a ball.

BACKGROUND OF THE INVENTION

Certain athletic sports require a player participant to handle some type of ball. For example, in a game of football players need to pass, catch, and carry a football without slippage of the ball in their hands. The quarterback must accurately grip the football in order to throw a pass, receivers need to catch the football with their hands, and in general when moving with the football, players need to hold the ball without fumbling it. Similarly, in a game of basketball players pass, catch, dribble, and shoot a basketball with their hands. All of these actions require gripping and/or handling of the ball. Also, in game of baseball or softball, players wear a baseball/softball glove on their non-throwing hand for catching the ball. However, players must handle and throw the ball with their free, throwing hand which requires that the throwing hand sufficiently grip the ball.

SUMMARY OF THE INVENTION

The present invention provides an athletic glove for gripping, handling, and catching of a sports ball such as a football, basketball, baseball, softball, or the like. The present athletic glove is also breathable to reduce sweating and collection of moisture inside of the glove. The present athletic glove may also include sensory openings that allow for direct tactile stimulation through the glove.

More particularly, an athletic glove in accordance with the present invention for use in handling a ball includes a single layer of elastic material forming a body that generally conforms in shape to a human hand. The body has four finger portions, a thumb portion, and an outer surface including a palmar side and a dorsal side. The palmar side and the dorsal side each include at least one breathable portion including a plurality of randomly disposed micropores. The four finger portions each include at least one longitudinal slit on the palmar side that provide for direct tactile stimulation of a hand through the glove.

Each of the four finger portions may specifically include two of the longitudinal slits. The thumb portion may also include at least one longitudinal slit on the palmar side, and specifically may include two of the slits. Each longitudinal slit may have a width of approximately 0.5 mm.

The breathable portion on the palmar side may be disposed in a palm area of the glove.

The body may be formed of a thin layer of a tear resistant latex material or similarly suitable elastic material. The outer surface of the palmar side may be textured to enhance friction and tack. Specifically, the entire outer surface of the body generally may be textured. The body may have a smooth inner surface.

These and other features and advantages of the invention will be more fully understood from the following detailed description of the invention taken together with the accompanying drawings.

DETAILED DESCRIPTION OF THE INVENTION

Figure 1:
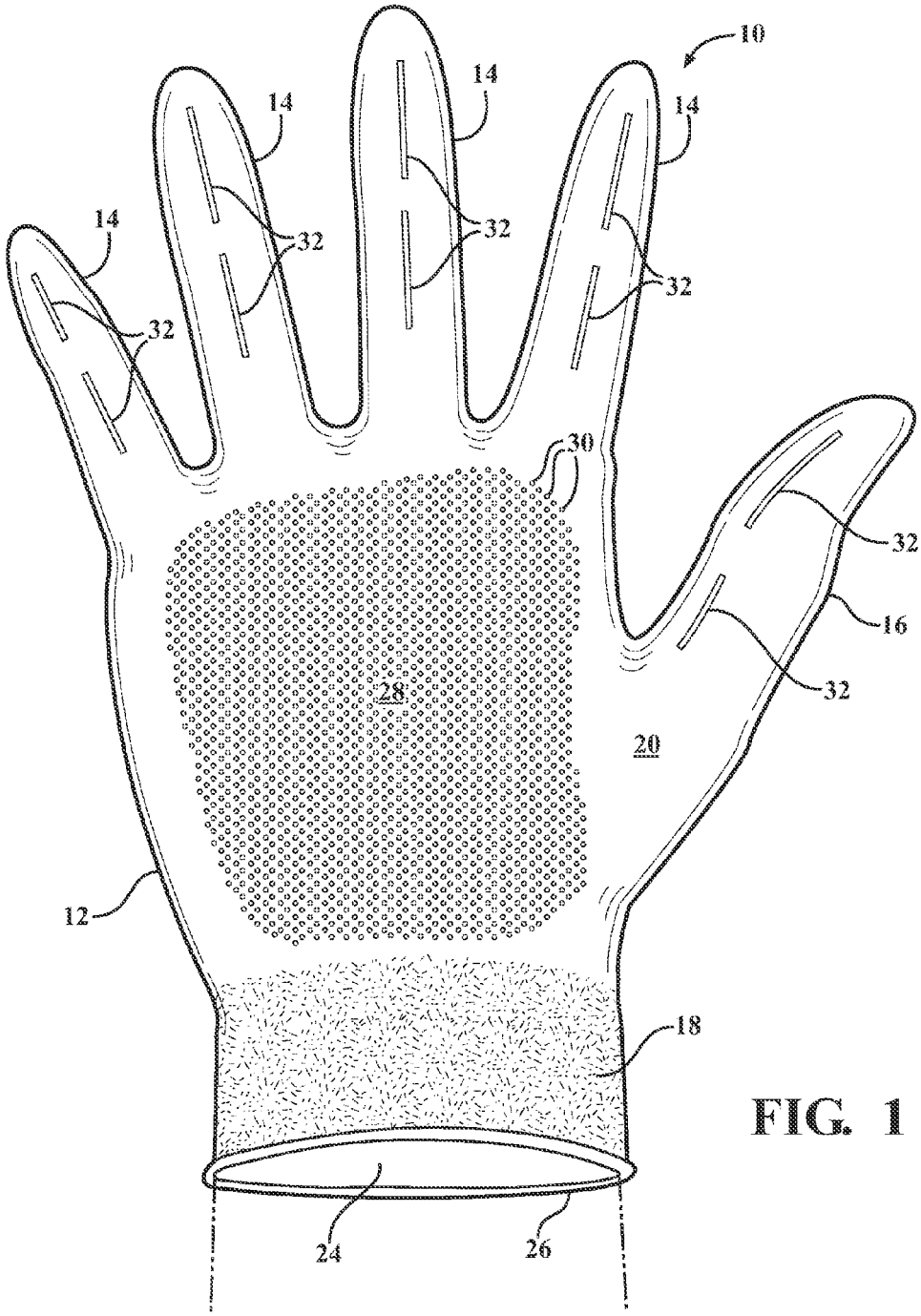
FIG. 1 is a perspective view of a palmar side of an athletic glove in accordance with the present invention.
Figure 2:
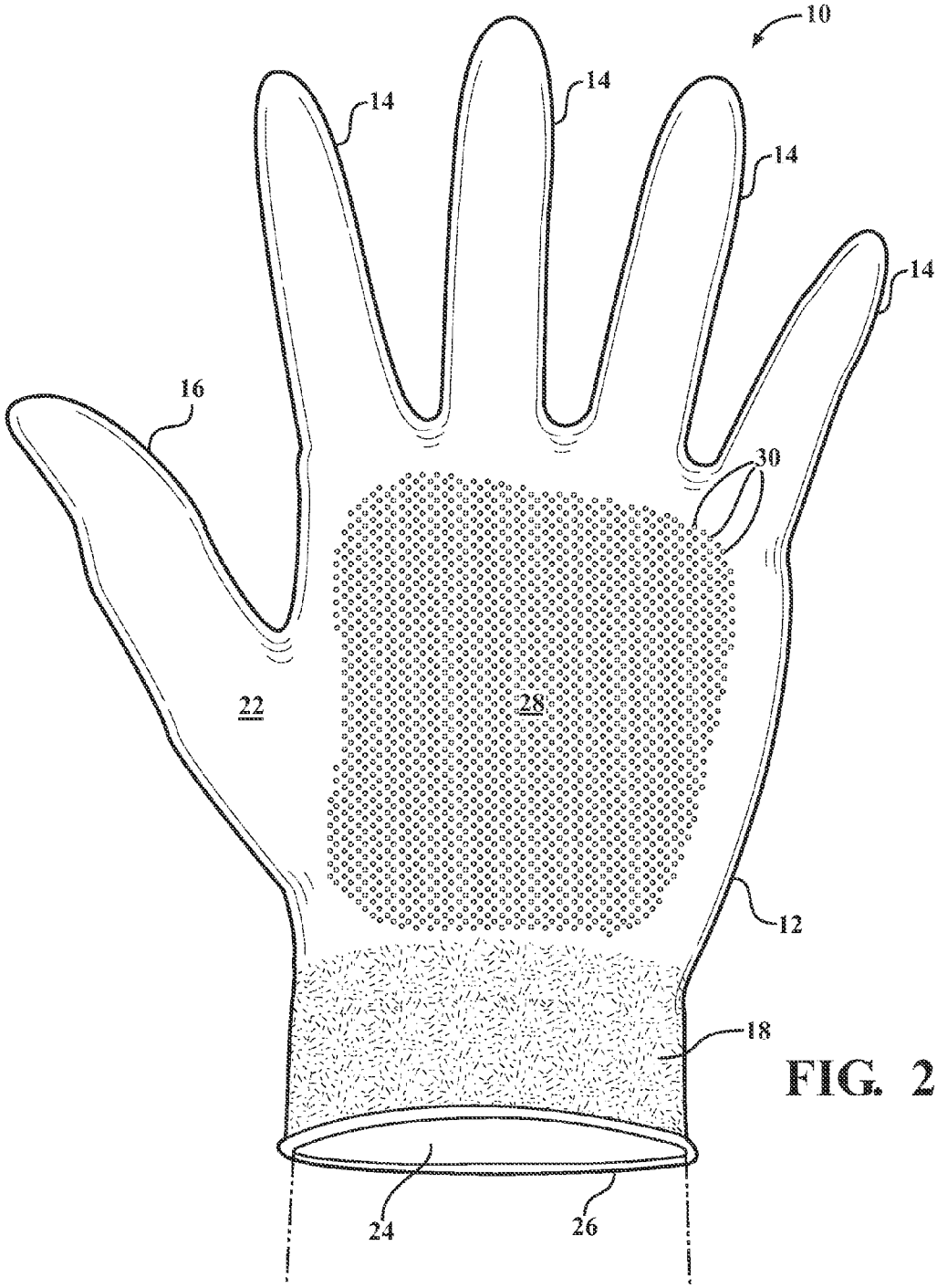
FIG. 2 is a perspective view of a dorsal side of the athletic glove.

Referring now to the drawings in detail, numeral 10 generally indicates an athletic glove in accordance with the present invention. As shown in FIGS. 1 and 2, the glove 10 includes a single layer of elastic material that forms a body 12 that generally conforms in shape to a human hand. Thus, the body 12 includes four finger portions 14, a thumb portion 16, and an outer surface 18 including a palmar side 20 (FIG. 1) and a dorsal side 22 (FIG. 2). The palmar side 20 of the glove generally covers a "front" gripping surface including the palm of a hand inserted into the glove, and the dorsal side 22 generally covers a back side of the hand. The body 12 also has an inner surface 24 facing the hollow inside of the glove 10, and an open, wrist end 26 for insertion of a hand into the hollow inner space of the glove. The body 12 may be sized so as to accommodate one of a variety of sizes of male or female human hands therein. Otherwise, the glove 10 is not limited to any particular size.

The elastic material forming the body 12 may be a tear resistant latex material, but other similarly suitable natural or synthetic elastic materials are within the scope of the invention. The elastic material of the body 12 has a high level of friction in relation to a ball such that the material allows a wearer of the glove to securely grip, catch, and handle a ball with a minimal amount of physical effort on the part of the user. A portion of the outer surface 18 of the body 12, such as the palmar side 20 which is used for gripping, or the entire outer surface may also be textured to enhance friction and tack when the glove comes into contact with another object such as a ball. For example, the outer surface may be formed to have random peaks and valleys for increased friction. Alternatively, the outer surface 18 of the body 12 may be coated with a tacky material or similar. For illustrative purposes, only a portion of the outer surface 18 is shown as textured in the drawings, although it should be understood that the entire outer surface may include the illustrated texturing.

The inner surface 24 of the body 12 may be generally smooth to provide for easy insertion and removal of a hand from inside the glove.

The palmar side 20 and dorsal side 22 of the glove 10 may each include at least one breathable portion/zone 28 that provides for the transmission of moisture and/or air from inside the body 12 of the glove to the outside atmosphere. Each breathable portion 28 includes a plurality of randomly disposed micropore openings 30 extending through the body 12 from the outer surface 18 to the inner surface 24. The micropores 30 may be perforations in the body 12 that allow the glove to breathe and may reduce sweating of a hand inserted into the glove. The micropores 30 are generally small in diameter but are not limited to any one particular size. The diameter of the micropores 30 is exaggerated in the drawing figures for illustrative purposes and the micropores are not necessarily as large as they are shown. One of the breathable portions 28 may be located in a palm area of the glove which generally corresponds to an area on the palmar side 20 between the base of the finger portions 14 and thumb portion 16. Another breathable portion 28 may be located in a back-hand area of the glove which generally corresponds to an area on the dorsal side 22 between the base of the finger portions 14 and the thumb portion 16.

The four finger portions 14 may each include at least one longitudinal slit 32 on the palmar side 20 of the body 12. In the embodiment shown in FIG. 1, each finger portion includes two linearly aligned and spacedly disposed longitudinal slits 32. Each slit may have a width that is approximately 0.5 mm, and may be formed by slicing/cutting the body or by removing a small portion of the body material. The width of the slits 34 is exaggerated in the drawing figures for illustrative purposes and the slits are not necessarily as wide as they are shown. The outboard slit 32 of each finger portion extends to a location proximate the tip of the respective finger portion for direct tactile stimulation through the glove of the tip of a finger of the hand. The slits thus provide for direct tactile stimulation of the underlying skin on the fingers when a wearer of the glove contacts an object with his/her hand. The slits thereby raise the level of tactile stimulation that a wearer of the glove receives when handling a ball, which enhances the wearer's ability to perform activities such as catching or holding a ball. The slits 32 also allow the finger portions 143 to breathe, thereby reducing finger sweating.

The thumb portion 16 of the body 12 may also include at least one longitudinal slit 32, and specifically may include two of the slits. The slit(s) 32 in the thumb portion 16 may generally have the same structure and function as the finger slits with the outboard slit 32 extending to a location proximate the tip of the thumb portion for direct tactile stimulation of the tip of the thumb of the hand.

The glove 10 may be made in any of a variety of colors or color combinations. The glove 10 also may include one or more logos printed thereon. The glove 10 is intended for one-time use (i.e., not used again after removing it from a wearer's hand) and may be discarded and/or recycled after use. However, it is within the scope of the invention for the glove to be used more than one time.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. An athletic glove for use in handling a ball, said glove comprising:

a single layer of elastic material forming a body that generally conforms in shape to a human hand;

said body having four finger portions, a thumb portion, and an outer surface including a palmar side and a dorsal side;

said palmar side including a palm area for overlying the palm of the hand;

said palmar side including at least one breathable portion extending over a major portion of the palm area and defining a plurality of closely-spaced micropores extending over the breathable portion and extending totally through the single layer of elastic material;

said four finger portions each including a first longitudinal slit on said palmar side that provides for direct tactile stimulation of a hand through said glove.

2. The athletic glove of claim 1, wherein the longitudinal slit on said palmar side extends to a location proximate a tip of the respective finger portion.

3. The athletic glove of claim 1, wherein said thumb portion includes a longitudinal slit on said palmar side extending to a location proximate a tip of the thumb portion.

4. The athletic glove of claim 3, wherein said material is a latex material.

5. The athletic glove of claim 3, wherein each said finger portion and said thumb portion longitudinal slit comprises a first and a second slit, the second slit independent of the first slip.

6. The athletic glove of claim 1, wherein each said longitudinal slit has a width of approximately 0.5 mm.

7. The athletic glove of claim 1, wherein said dorsal side also includes a breathable portion including a plurality of closely-spaced micropores.

8. The athletic glove of claim 1, wherein the body is formed of a thin layer of a tear resistant latex material.

9. The athletic glove of claim 1, wherein the outer surface of said palmar side is textured to enhance friction and tack.

10. The athletic glove of claim 9, wherein substantially the entire outer surface of said body is textured.

11. The athletic glove of claim 1, wherein said body has a smooth inner surface.

12. An athletic glove for use in holding a ball, said glove comprising:

a single layer of elastic material forming a body that generally conforms in shape to a human hand;

said body having four finger portions, a thumb portion, and an outer surface including a palmar side and a dorsal side;

wherein each of said finger portions including a longitudinal slit on the palmar side extending to a location proximate a tip of the finger portion for direct tactile stimulation of a tip of a finger of the hand through the glove.

13. An athletic glove according to claim 12 wherein each finger portion longitudinal slit comprises a first and a second slit, the second slit aligned with the first slit.

14. An athletic glove according to claim 12 wherein the thumb portion also includes a longitudinal slit extending to a location proximate the tip of the thumb portion.

15. An athletic glove for use in holding a ball, said glove comprising:

a single layer of elastic material forming a body that generally conforms in shape to a human hand;

said body having four finger portions, a thumb portion, and an outer surface including a palmar side and a dorsal side;

wherein each of said finger portions including a first longitudinal slit and a second longitudinal slit aligned with the first slit, one of the first or the second longitudinal slits extending to a location proximate a tip of the respective finger portion for direct tactile stimulation of a tip of a finger of the hand through the glove.

* * * * *